United States Patent [19]

Cederquist

[11] 3,969,184

[45] July 13, 1976

[54] DIGESTION ODOR CONTROL

[75] Inventor: Karl Nicolaus Cederquist, Stockholm, Sweden

[73] Assignee: Defibrator AB, Stockholm, Sweden

[22] Filed: Mar. 19, 1975

[21] Appl. No.: 559,917

Related U.S. Application Data

[63] Continuation of Ser. No. 484,779, July 1, 1974, abandoned, which is a continuation of Ser. No. 258,547, June 1, 1972, abandoned.

[52] U.S. Cl. ..... 162/19; 162/34; 162/36; 162/40; 162/42; 162/45; 162/51; 162/65; 162/82; 162/86; 162/90

[51] Int. Cl.[2] ..... D21C 11/08

[58] Field of Search ..... 162/19, 30, 34, 36, 162/37, 40, 42, 41, 45, 51, 65, 82, 86, 90

[56] References Cited

UNITED STATES PATENTS

| | | | |
|---|---|---|---|
| 486,339 | 11/1892 | Johnston | 162/65 |
| 1,454,339 | 5/1923 | Richter | 162/51 |
| 1,818,913 | 8/1931 | Carr | 162/41 |
| 2,830,869 | 4/1958 | Limerick | 162/51 X |
| 3,347,739 | 10/1967 | Tomlinson | 162/30 |
| 3,362,868 | 1/1968 | Backlund | 162/51 X |
| 3,525,665 | 8/1970 | Gessner | 162/65 X |
| 3,549,314 | 12/1970 | Shah | 162/30 X |
| 3,617,434 | 11/1971 | Nakafuri et al. | 162/36 X |
| 3,796,628 | 3/1974 | Sen | 162/51 X |
| 3,842,160 | 10/1974 | Brannland et al. | 162/51 X |

OTHER PUBLICATIONS

Canovali et al., "Case History of . . . Odor Reduction System," TAPPI, vol. 53, No. 8, 8–1970, pp. 1488–1493.

*Primary Examiner*—Robert L. Lindsay, Jr.
*Assistant Examiner*—Arthur L. Corbin
*Attorney, Agent, or Firm*—Eric Y. Munson

[57] ABSTRACT

The invention relates to a continuous method of making cellulosic pulp from wood chips within a range of yield from 65 to 90 per cent by digestion with a digestion liquor containing $Na_2S$ and $Na_2CO_3$. The digestion is effected at temperatures between 150° and 190°C and malodorous sulfur compounds are removed from the pulp, the liquor and the vapors prior to their withdrawal from the digesting process. In order to eliminate their capacity of emitting obnoxious odors, the sulfur compounds are oxidized by addition of molecular oxygen to the digester prior to discharge of pulp and spent liquor from the digester after which the spent liquor is removed from the digested pulp, concentrated and burned for renewed use in preparation of fresh digesting liquor.

3 Claims, 1 Drawing Figure

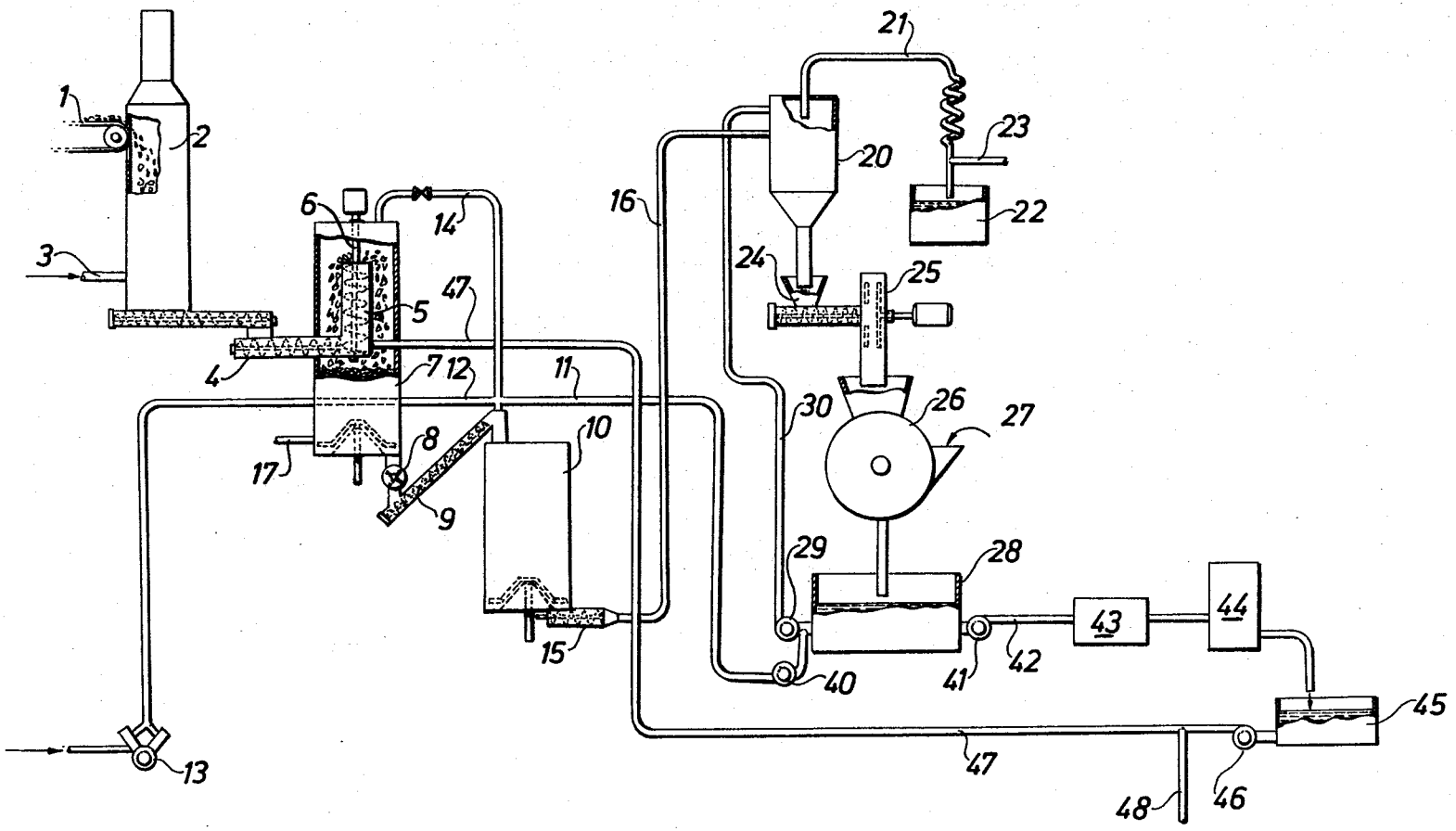
1
2
3
4
5
6
7
8
9
10
11
12
13
14
15
16
17
20
21
22
23
24
25
26
27
28
29
30
40
41
42
43
44
45
46
47
48

DIGESTION ODOR CONTROL

This is a continuation of application Ser. No. 484,779 filed July 1, 1974, now abandoned, which in turn is a continuation of application Ser. No. 258,547 filed June 1, 1972, now abandoned.

FIELD OF THE INVENTION

This invention relates to a method in the making of semi-chemical pulp by means of alkaline digesting liquid having as main constituents $Na_2S$ and $Na_2CO_3$ (green liquor).

THE PRIOR ART

In the making of semi-chemical sulfate pulp by digestion of disintegrated, lignocellulose containing material such as wood, bagasse, straw and similar materials, which in the subsequent specification will be commonly denominated wood chips or chips, by means of alkaline digesting liquid, also called "green liquor", difficult and intricate problems with the obnoxious odour resulting from sulfur containing organic substances which are produced as by-products, must be solved. Such obnoxious odors make themselves noticed both in the blowingoff and in the emptying of digesters or cookers. Part of these sulfur containing compounds remain perceptible in the pulp after the washing thereof and also in the paper manufactured from the pulp. It has thus developed that it is impossible to employ the pulp for the manufacture of "corrugating medium" because the foul smelling substances in the paper escape in vapor phase during the corrugating process and cause very difficult problems of air pollution.

OBJECTS OF THE INVENTION

One main object of the invention is to provide a digestion method for making semi-chemical sulfate pulp by means of an alkaline digestion liquid of the kind set forth, which method ensures that the malodorous sulfur compounds obtained as by-products in the digestion process are effectively prevented from making themselves noticed in any of the products in the form of digested pulp, liquor or vapors leaving the digester or cooker during, or after completion of the digestion process.

Another object of the invention is to provide a continuous digestion method for the making of semi-chemical sulfate pulp from lignocellulose containing chips by means of an alkaline digesting liquid having $Na_2S$ and $Na_2CO_3$ as main constituents, which in addition to the complete elimination of the malodorous sulfur compounds make it possible to use liquor recovered from the digestion process as fresh alkaline digesting liquid.

MAIN FEATURES OF THE INVENTION

It has now proved possible to remove the malodorous smelling constituents, which are formed in the digesting process by gases, such as air, under pressure and at an increased temperature not however exceeding 150°C and suitably maintained between 120° and 150°C, immediately after the completion of the digesting treatment whereby a rapid oxidation is obtained without any risk of decomposition of the pulp. In this manner the digesting process can be finished without malodorous substances escaping with vapors, pulp or liquor in connection with the discharging of the digester.

After a washing step the pulp is absolutely unobjectionable as far as its odor is concerned and can be processed further into paper and corrugated for manufacture of corrugated board without escape of obnoxious gases and vapors.

The waste liquor, which also is free from malodorous substances, can be concentrated by evaporation without loss of sulfur in the escaping condensate, which also is free from malodorous substances, so that it can be returned as manufacturing water or discharged, if desired, without difficulty.

The liquor evaporated to suitable concentration can be burned in known manner for production of black ash or crude sodium carbonate, which can be dissolved again in water for preparation of new digestion liquid. The combustion can be performed either in a soda recovery unit with simultaneous production of steam or in a soda furnace under utilization of the physical heat of the escaping flue gases for concentration by evaporation of liquor through direct contact.

In a recycle process for recovery of the chemicals some losses always are incurred, which among other reasons result from the washing of the pulp and the combustion of the liquor. Calculated as $Na_2O$, usually between 10 and 15 percent of the chemicals are lost in the recycling process and can in the present case be replaced for example by the addition of sodium sulfate to the waste liquor. However, it is more suitable to replace the losses by supply of an adequate quantity of $Na_2O$ as alkaline sulfite solution to the digestion liquor because in this way the mechanical strength of the pulp is improved considerably. As far as it is possible to utilize part of the green liquor for other purposes, it is suitable to replace between 20 and 25 percent of the $Na_2O$ entering into the digestion process by sodium sulfite.

As mentioned above, the method according to the present invention is particularly suitable for the manufacture of soda pulps in the range of yield between 65 and 90 percent and usually 75 and 85 percent, in which connection the consumption of chemicals can be limited to 50 to 80 kgs $Na_2O$ per ton chips depending on the kind of wood, the yield, the duration and temperature of the digestion. This makes it possible to carry out the digestion with substantial advantage in vapour phase with chips impregnated with liquor, whereby also favourable conditions are provided for the oxidizing action, partly by the exposed surfaces of the individual chips and partly by the free volume in the digester, which makes it possible subsequently to supply molecular oxygen even in the form of air in a sufficient quantity without having to to resort to percolation, which is the case when the digestion is carried out in liquid phase. The consumption of oxygen for removal of the malodorous substances usually does not exceed 10-12 cubic meters per ton chips, which corresponds to 50 to 60 cubic meters of air.

The length of time required for digestion and oxidation will be short. For example, from birch chips digested in vapor phase at a temperature of 160°C and under a vapor pressure of about 6 atmospheres above atmospheric and during a digestion time of 10 minutes a yield of 79 percent was obtained. The digesting liquor contained, calculated as $Na_2O$, 35 grams $Na_2S$, 32 grams $Na_2CO_3$ and 12 grams $Na_2SO_3$, all of them calculated per liter, and the chips absorbed 70 grams $Na_2O$ per kilogram of chips. When the digestion had been completed, the chips with their liquor content were immediately cooled down to 130°C and so much air was supplied so that the total vapor-gas pressure became 7 atmospheres above atmospheric, which pressure was maintained constantly for 10 minutes. Thereafter the digester was blown off and emptied of pulp and liquor without that any unpleasant odor being observed in the vapors, the pulp or the liquor.

In a simultaneously performed test of identical kind but without oxidation, no appreciable difference in the strength values of the pulps could be appreciated, which result shows that the oxidation had not decomposed the pulp to any demonstrable degree.

The oxidation can be performed within the temperature range of 100° to 150°C, but in order to obtain a rapid oxidation reaction without danger of decomposition of the pulp it is suitable to maintain the temperature in the oxidation step within the temperature range of 120° to 150°C.

The cooling of the digested pulp is most suitably effected by injection of cold oxidized liquor, which in the case that larger quantities of heat must be removed is suitably effected by circulation of liquor over the pulp and indirect cooling of the liquor during the circulation thereof.

In the making of pulp in a greater scale it is suitable to carry out the process continuously in vapor phase with pulp, which has been steamed and well impregnated with digestion liquid, as starting material. The impregnation with digestion liquid can be effected in various known manners for instance by steaming and subsequent impregnation of the pulp and allowing expansion thereof within the digestion liquid or by treatment under reduced pressure or by hydrostatic pressure, or both of said latter methods in combination. The pulp, from which excess of free digestion liquid has been removed, is thereupon heated at a first station with direct steam to digestion temperature and is maintained at said temperature for such a period of time that the decomposition is effected to desired yield. Thereafter the digested pulp with its content of liquor is fed through a sluicing device to another station and is cooled for instance by being sprayed with cold oxidized liquor until a temperature suited for the oxidation in the range between 120° and 150°C is reached, and simultaneously moleculary oxygen is introduced so as to stream in the same direction as the flow of entering chips and in such a quantity that the total pressure of vapor and gas becomes equal with or suitably slightly below the steam pressure at the first station. Upon finished oxidation, the pulp and the liquor are blown into a centricleaner, in which entrained gas and vapor are separated off. If desired, the blowing out of the pulp can be effected through a defibering equipment. The pulp and the liquor are now entirely free of foul odor emitting compounds and, after a suitable defibration operation, liquor is removed from the pulp in known manner by washing or pressing, and thereupon refined to desired beating degree. Part of the recovered liquor is recycled for cooling the digested chips and the remainder is concentrated by evaporation and burned for production of new digesting liquid.

DESCRIPTION OF A PREFERRED EMBODIMENT

By way of example, an embodiment of the continuous process will now be described with reference to the attached drawing, which forms part of this specification and which diagrammatically shows the various processing stages.

From a conveyor 1, chips fall down into a steaming vessel 2, to which steam is supplied through a pipe 3. Thereupon the steamed chips are fed by means of a feeder 4 adapted to form a sealing plug into an impregnating vessel 5, which is subjected to the pressure prevailing in a digester 7 forming part of the system and is by means of a helical feeder 6 carried upwards through the digesting liquid and falls down into the digester 7 as disclosed for instance in U.S. Pat. No. 3,338,525. Digesting liquid is supplied through a pipe 47. A quantity of $Na_2O$ adequate to compensate for the losses in chemicals is supplied in the form of $Na_2SO_3$ through a conduit 48. Living steam is supplied to the digester through a pipe 17 so that the temperature in the digester is maintained at a constant level, such as 160°C. The duration of stay of the chips in the digester at said temperature may be 10 minutes depending on the desired yield. The digested chips together with their content of liquor are fed through a sluicing feeder 8 and a screw conveyor 9 into an oxidation vessel 10. Simultaneously, cold liquor is supplied through a pipe 11 so that incoming material is cooled to 130°C for example and at the same time air is supplied from a compressor 13 through a conduit 12 so that the total vapour-gas pressure at the oxidation station 10 is maintained just below the pressure in the digester 7 in order to enable the sluice feeder to operate. The duration of stay at the oxidation station is most suitable about 10 minutes. Pulp and accompanying liquor, vapor and gas are continuously blown out through a valve 15. Air under pressure is introduced all the time so that the pressure remains constant. The pulp is blown through a conduit 16 into a centricleaner 20 from which vapor and gases escape through a conduit 21 and are cooled. Condensate is collected in a receiver 22 and non-condensable gases are exhausted through a pipe 23. From the centricleaner 20, the pulp falls down into a hopper 24 and is fed into a defibrator or other grinding apparatus 25. At the same time oxidized liquor is supplied to the centricleaner through a conduit 30 to facilitate the flushing of pulp out of the centricleaner. From the defibrator 25 pulp and liquor are discharged to at least one press 26 for recovery of liquor. Recovered liquor is collected in a tank 28 and the pulp is conveyed further through an outlet 27 in the press. Liquor is circulated by means of a pump 29 and through a pipe 30 into the centricleaner 20, and, by means of a pump 40 and the pipe 11, cold liquor is supplied to the oxidation station. The recovered liquor is pumped by means of a pump 41 and through a pipe 42 into evaporator 43 and thickened liquor is fed further to a soda furnace 44. Resultant black ash or crude sodium carbonate is dissolved in a tank 45 to prepare new digesting liquid which by means of a pump 46 through a pipe 47 is returned to the impregnation vessel 5. Non-condensable gases possibly formed during the digesting operation can be exhausted through a pipe 14 and fed to the oxidation station.

The cooling of the digested chips during their transfer from the first (digestion) to the second (oxidation) station can be effected in an indirect way, for instance in a water cooled conveyor.

While one more or less specific embodiment of the invention has been shown and described, it is to be understood that this is for the purpose of illustration only, and that the invention is not to be limited thereby, but its scope is to be determined by the appended claims.

I claim:

1. Method of producing cellulosic pulp having a yield ranging between 65–90% from lignocellulosic material by digesting said material with a digesting liquor containing $Na_2S$ and $Na_2CO_3$, said pulp and the by-products resulting from the digestion being substantially free from malororous constituents prior to withdrawal from the digesting process without the need for individual isolation and treatment comprising:

a. impregnating the lignocellulosic material with digesting liquor and digesting the impregnated material in a digester at a temperature ranging between 150°–190°C in vapor phase in an atmosphere of saturated steam corresponding to the digesting temperature;

b. thereafter cooling the digester with its total contents including solids, fluids, vapors and noncondensable gases to a temperature ranging between 120°–150°C by spraying cold oxidized spent liquor over the entire digester contents and introducing molecular oxygen into the digester at said temperature and under superatmospheric pressure for a time sufficient to obtain rapid oxidation of said total contents without decomposition of the pulp while substantially eliminating the malodorous constituents from the contents;

c. then discharging pulp and spent liquor from the digester and recovering the spent liquor from the pulp;

d. concentrating the recovered spent liquor by evaporation of water;

e. burning the concentrated spent liquor to yield a smelt consisting essentially of $Na_2S$ and $Na_2CO_3$; and f. dissolving said smelt in water for regenerating fresh digesting liquor for re-use.

2. The method as claimed in claim 1 further comprising adding to the digesting liquor an alkaline reacting solution of sodium sulphite, the quantity of which, calculated as $Na_2O$, at least amounts to that quantity of $Na_2O$ which is lost in the digesting steps and the recovery cycle.

3. The method as claimed in claim 1, further comprising continuously carrying out the digestion of the impregnated lignocellulosic material in vapor phase at a first station and thereafter sluicing the pulp mass including spent liquor and vapors to a second station and cooling the whole mass and supplying molecular oxygen to the second station in such a quantity and pressure that the total pressure at the second station is lower than the prevailing steam pressure at the first station.

* * * * *

UNITED STATES PATENT OFFICE

CERTIFICATE OF CORRECTION

Patent No. 3,969,184 Dated July 13, 1976

Inventor(s) K. N. CEDERQUIST

It is certified that error appears in the above-identified patent and that said Letters Patent are hereby corrected as shown below:

[30] Foreign Application Priority Data

June 4, 1971 Sweden.....7293/1971

Signed and Sealed this

Fourteenth Day of December 1976

[SEAL]

*Attest:*

RUTH C. MASON
*Attesting Officer*

C. MARSHALL DANN
*Commissioner of Patents and Trademarks*